US006843433B1

(12) United States Patent
Ryou

(10) Patent No.: US 6,843,433 B1
(45) Date of Patent: Jan. 18, 2005

(54) SWIRL NOZZLE AND SWIRL NOZZLE ASSEMBLY HAVING FILTER

(76) Inventor: Hong-Sun Ryou, 203-1704 LG Village APT. Seongbok-dong, Suji-eup, Yongin-si, Kyoungki do (KR)

( * ) Notice: Subject to any disclaimer, the term of this patent is extended or adjusted under 35 U.S.C. 154(b) by 0 days.

(21) Appl. No.: 10/635,632

(22) Filed: Aug. 5, 2003

(30) Foreign Application Priority Data

Jun. 12, 2003 (KR) ..... 20-2003-0018425

(51) Int. Cl.[7] ..... B05B 1/34
(52) U.S. Cl. ..... 239/462; 239/464; 169/46
(58) Field of Search ..... 239/461–464, 239/470–472, 488, 489; 169/15, 46, 68

(56) References Cited

U.S. PATENT DOCUMENTS 4,360,156 A * 11/1982 Soth et al. ..... 239/11
6,129,290 A * 10/2000 Nikkanen ..... 239/2.2
6,517,012 B1 2/2003 Slowik et al.

* cited by examiner

*Primary Examiner*—Gene Mancene
*Assistant Examiner*—Thach H. Bui
(74) *Attorney, Agent, or Firm*—Roth & Goldman, P.A.

(57) ABSTRACT

A swirl nozzle assembly connected to a water supplying pipe. A main body has one end coupled to the water supplying pipe and the other end internally threaded to form a coupling part. A filter is positioned in an accommodating space which is defined inward of the coupling part of the main body, to filter foreign substances contained in the fire extinguishing water. A nozzle receiving element has one end coupled to the coupling part of the main body with the filter fixedly maintained inward of the coupling part, and the other end internally threaded to form a nozzle coupling part. The nozzle receiving element is defined with a water collecting chamber. A swirl nozzle is coupled to the nozzle coupling part of the nozzle receiving element and is structured to allow water droplets of a predetermined size to be sprayed at a predetermined scattering angle.

3 Claims, 2 Drawing Sheets

SWIRL NOZZLE AND SWIRL NOZZLE ASSEMBLY HAVING FILTER

BACKGROUND OF THE INVENTION

1. Field of the Invention

The present invention relates, in general, to a swirl nozzle and a swirl nozzle assembly and, more particularly, to a swirl nozzle and a swirl nozzle assembly having a filter, which are constructed to be installed on a ceiling to thereby quickly extinguish a fire when it breaks out.

2. Description of the Prior Art

Generally, if a fire breaks out in a large building, a great deal of water is sprinkled from fire sprinklers installed on a ceiling of a building.

In the conventional fire sprinkler, a water discharging port through which water is sprinkled to a room is formed in a sprinkler head. A pair of support frames having a high strength constitute a part of the sprinkler head. A deflector is coupled to a distal end of the support frame to uniformly distribute water which is discharged when the sprinkler head is opened. By tightening a bolt which is provided at a center portion of the deflector, a heat sensing part as a whole is biased toward the water discharging port of the sprinkler head. The heat sensing part is composed of several metal segments which are assembled one with another. A heat-fusible metal piece is embedded in a center portion of the heat sensing part. If the heat-fusible metal piece is fused by heat generated when a fire breaks out, the heat sensing part is freed or released from the sprinkler head, and the sprinkler head is opened, by which water is discharged through the water discharging port.

However, in the conventional fire sprinkler constructed as mentioned above, since a fire is extinguished by discharging a great deal of water, in the case that the room is equipped with costly electronic equipment, the electronic equipment cannot be properly protected, and an economic loss is increased.

Further, in the case that a fire is very serious, because it is difficult to extinguish the fire using water discharged from the fire sprinklers, rapid extinguishment of the fire is prevented. Due to the use of the great deal of water, electric devices cannot be reused or even repaired.

Also, by the fact that the water discharging port of the conventional fire sprinkler has a relatively small inner diameter, if foreign substances produced due to corrosion of a water supplying pipe are contained in the fire extinguishing water, the possibility of the water discharging port to be plugged is increased. Therefore, operational reliability of the fire sprinkler cannot but be deteriorated.

SUMMARY OF THE INVENTION

Accordingly, the present invention has been made keeping in mind the above problems occurring in the prior art, and an object of the present invention is to provide a swirl nozzle and a swirl nozzle assembly having a filter, which are constructed to interrupt air supply to a flame for rapid extinguishment of a fire when it breaks out, protect costly electronic equipment, filter foreign substances produced due to corrosion of a water supplying pipe and contained in fire extinguishing water to be sprinkled, and spray water for quick extinguishment of the fire.

In order to achieve the above object, according to one aspect of the present invention, there is provided a swirl nozzle assembly connected to a water supplying pipe for supplying fire extinguishing water at a predetermined pressure, comprising: a main body having one end which is threadedly coupled to the water supplying pipe to be held fastened in a direction where the fire extinguishing water is supplied and the other end which is internally threaded to form a coupling part; a filter positioned in an accommodating space which is defined inward of the coupling part of the main body, to filter foreign substances contained in the fire extinguishing water; a nozzle receiving element having one end which is threadedly coupled to the coupling part of the main body with the filter fixedly maintained inward of the coupling part, and the other end which is internally threaded to form a nozzle coupling part, the nozzle receiving element being defined with a water collecting chamber; and a swirl nozzle threadedly coupled to the nozzle coupling part of the nozzle receiving element and structured to allow water droplets of a predetermined size to be sprayed at a predetermined scattering angle.

According to another aspect of the present invention, the filter has a mesh size which is less than a diameter of a swirl guide hole of the swirl nozzle.

According to still another aspect of the present invention, there is provided a swirl nozzle connected to a water supplying pipe for supplying fire extinguishing water at a predetermined pressure, comprising: a nozzle body formed on an outer surface thereof with an external thread which is to be airtightly screwed into the water supplying pipe, and defined with a swirl space for swirling movement of the fire extinguishing water; a flow resistance-reducing part protruding upward from an upper end of the nozzle body while being separated from an inner surface of the water supplying pipe by a predetermined distance, and having a semi-spherical configuration to reduce water flow resistance when fire extinguishing water is introduced into the swirl space; at least one swirl guide hole defined between the flow resistance-reducing part and the nozzle body in a manner such that it extends in a tangential direction with respect to an inner surface of the nozzle body to cause swirl flow of the fire extinguishing water; and a spraying element airtightly screwed at an upper end thereof into a lower end of the nozzle body and having an inner diameter which is gradually decreased toward a spraying hole defined at a lower end thereof.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
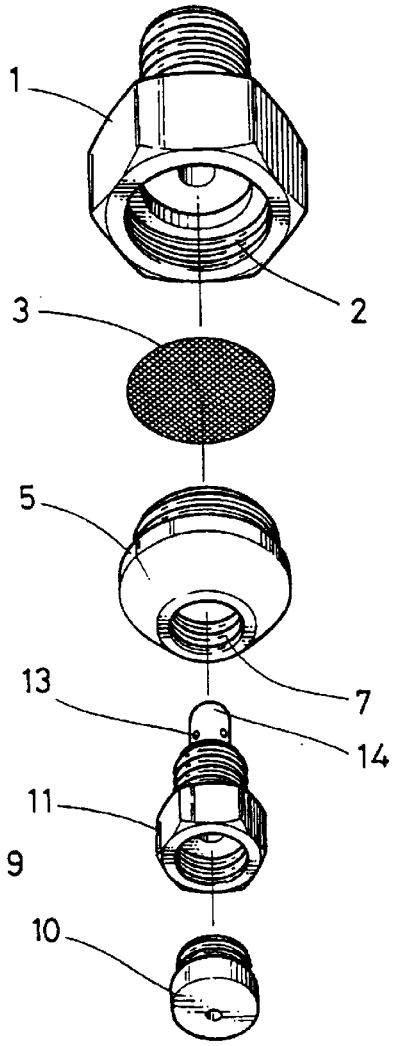
FIG. 1 is an exploded perspective view illustrating a swirl nozzle assembly having a filter in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
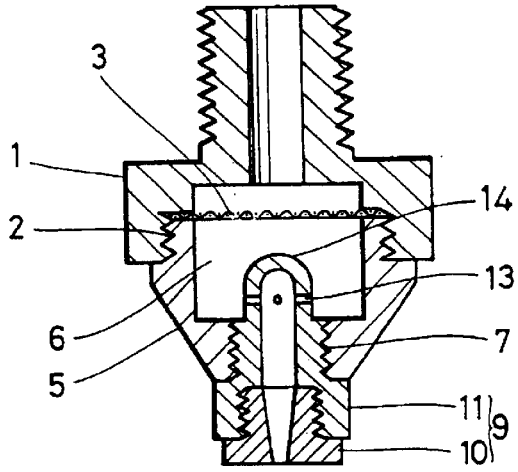
FIG. 2 is a longitudinal sectional view illustrating an assembled state of the swirl nozzle assembly shown in FIG. 1.
Figure 3:
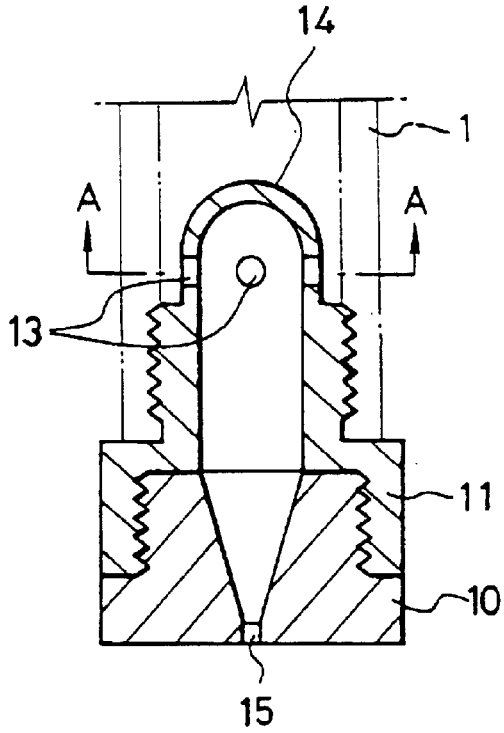
FIG. 3 is a longitudinal sectional view illustrating a swirl nozzle in accordance with the embodiment of the present invention.
Figure 4:
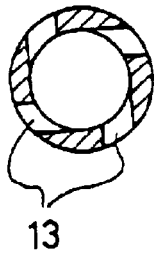
FIG. 4 is a transverse sectional view taken along the line A—A of FIG. 3.

FIG. 1 is an exploded perspective view illustrating a swirl nozzle assembly having a filter in accordance with an embodiment of the present invention; FIG. 2 is a longitudinal sectional view illustrating an assembled state of the swirl nozzle assembly shown in FIG. 1; FIG. 3 is a longitudinal sectional view illustrating a swirl nozzle in accordance with the embodiment of the present invention; and FIG. 4 is a transverse sectional view taken along the line A—A of FIG. 3.

As can be readily seen from FIGS. 1 and 2, a swirl nozzle assembly having a filter in accordance with an embodiment of the present invention is connected to a water supplying pipe (not shown) for supplying fire extinguishing water at a predetermined pressure.

The swirl nozzle assembly includes a main body 1. The main body 1 has one end which is threadedly coupled to the water supplying pipe to be held fastened in a direction where the fire extinguishing water is supplied, and the other end which is internally threaded to form a coupling part 2. The coupling part 2 is structured to allow continuous supply of the fire extinguishing water. A nozzle receiving element 5 as will be described below in detail is threadedly coupled into the coupling part 2.

The nozzle receiving element 5 is defined with a water collecting chamber 6 in which the fire extinguishing water is collected. The nozzle receiving element 5 has an upper end which is threadedly coupled to the coupling part 2 of the main body 1, and a lower end which is internally threaded to form a nozzle coupling part 7. A swirl nozzle 9 is threadedly coupled to the nozzle coupling part 7 of the nozzle receiving element 5. The swirl nozzle 9 is structured to swirl, at a high pressure, the fire extinguishing water collected in the water collecting chamber 6, to thereby form water droplets of a predetermined size and then spray the water droplets toward the outside at a predetermined scattering angle. Here, the threaded coupling between the nozzle receiving element 5 and the main body 1 is implemented in an airtight manner so that they can stand the high operating pressure.

A filter 3 is disposed between the main body 1 and the nozzle receiving element 5 to filter foreign substances (produced due to corrosion of the water supplying pipe, etc.) contained in the fire extinguishing water. Here, the filter 3 has a mesh size which is less than a diameter of a swirl guide hole 13 of the swirl nozzle 9 to allow free passage of the fire extinguishing water therethrough.

The swirl nozzle 9 comprises a spraying element 10 and a nozzle body 11 which are integrally assembled with each other.

Referring to FIGS. 3 and 4, a flow resistance-reducing part 14 protrudes upward from an upper end of the nozzle body 11 while being separated from an inner surface of the water supplying pipe by a predetermined radial distance. The flow resistance-reducing part 14 has a semi-spherical configuration to reduce water flow resistance and ensure swirl flow of the fire extinguishing water when the fire extinguishing water is introduced into the nozzle body 11. At least one swirl guide hole 13 is defined between the flow resistance-reducing part 14 and the nozzle body 11 in a manner such that it extends in a tangential direction with respect to an inner surface of the nozzle body 11 to cause swirl flow of the fire extinguishing water.

In this preferred embodiment of the present invention, 2 to 8 swirl guide holes 13 are defined along a circumferential direction of the nozzle body 11 so that they are equally separated one from another while being slightly deflected within an interval between a center line and a tangential line. Since the swirl flow of the fire extinguishing water is created to be rotated rightward with respect to a spraying direction of the fire extinguishing water, a slight change in angular velocity occurs adjacent to a spraying hole 15 of the spraying element 10 in a direction of right-handed screw.

The spraying element 10 splits the fire extinguishing water into fine water droplets using a pressure differential which results from rotary spray of swirl flow. Then, the spraying element 10 sprays the fine water droplets to a predetermined solid angle. This solid angle is inversely proportional to a size of the spraying hole 15. In particular, due to the fact that an inner diameter of the spraying element 10 is gradually decreased toward the spraying hole 15 which is defined at a lower end of the spraying element 10, an angular velocity of the swirl flow is increased in arithmetical series. Therefore, in the case that the fire extinguishing water is discharged through the spraying hole 15, a thin water layer is formed over a scattering angle of maximum 95°, and thereby fine water droplets are created.

The fire extinguishing water of a predetermined pressure flows through the swirl guide holes 13. At this time, the number of the swirl guide holes 13 is proportional to a solid angle through which the water droplets are sprayed through the spraying hole 15.

The swirl nozzle and the swirl nozzle assembly having a filter according to the present invention, constructed as mentioned above, can be connected to a water supplying pipe for supplying fire extinguishing water at a predetermined pressure, in such a way as to split the fire extinguishing water into fine water droplets and disperse the split water droplets toward a flame when a fire breaks out. Due to the presence of a filter according to the present invention, the problem of the conventional art is solved. That is to say, as foreign substances produced due to corrosion of the water supplying pipe are filtered, water flow in the swirl nozzle is not obstructed. Therefore, it is possible to reliably extinguish the fire.

The present invention provides advantages in that air supply to a flame is interrupted for early extinguishment of a fire when it breaks out, and costly electronic equipment can be prevented from being damaged. Consequently, it is possible to minimize a secondary loss due to a fire and avoid waste of resources.

Further, since each of the swirl nozzle and swirl nozzle assembly having a filter according to the present invention can be directly connected to a main water supplying pipe while obviating the need for additional piping, installation, repair and maintenance can be conveniently implemented. Also, because each of the swirl nozzle and swirl nozzle assembly according to the present invention is operated at an intermediate or low level of pressure, a pressurization system can be constructed in a simple manner, and a useful operating life of the swirl nozzle and swirl nozzle assembly can be lengthened due to a decrease in stress.

Moreover, by the fact that foreign substances produced due to corrosion of the water supplying pipe and contained in fire extinguishing water to be sprinkled are filtered, it is possible to appropriately cope with the fire. Furthermore, as the water droplets are continuously sprayed for quick extinguishment of the fire, a lifetime of the water supplying pipe can be extended.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A swirl nozzle assembly connected to a water supplying pipe for supplying fire extinguishing water at a predetermined pressure, comprising:

a main body having one end which is threadedly coupled to the water supplying pipe to be held fastened in a direction where the fire extinguishing water is supplied and the other end which is internally threaded to form a coupling part;

a filter positioned in an accommodating space which is defined inward of the coupling part of the main body, to filter foreign substances contained in the fire extinguishing water;

a nozzle receiving element having one end which is threadedly coupled to the coupling part of the main body with the filter fixedly maintained inward of the coupling part, and the other end which is internally threaded to form a nozzle coupling part, the nozzle receiving element being defined with a water collecting chamber; and a swirl nozzle threadedly coupled to the nozzle coupling part of the nozzle receiving element and structured to allow water droplets of a predetermined size to be sprayed at a predetermined scattering angle.

2. The swirl nozzle assembly as set forth in claim 1, wherein the filter has a mesh size which is less than a diameter of a swirl guide hole of the swirl nozzle.

3. A swirl nozzle connected to a water supplying pipe for supplying fire extinguishing water at a predetermined pressure, comprising:

a nozzle body formed on an outer surface thereof with an external thread which is to be airtightly screwed into the water supplying pipe, and defined with a swirl space for swirling movement of the fire extinguishing water;

a flow resistance-reducing part protruding upward from an upper end of the nozzle body while being separated from an inner surface of the water supplying pipe by a predetermined distance, and having a semi-spherical configuration to reduce water flow resistance when fire extinguishing water is introduced into the swirl space;

at least one swirl guide hole defined between the flow resistance-reducing part and the nozzle body in a manner such that it extends in a tangential direction with respect to an inner surface of the nozzle body to cause swirl flow of the fire extinguishing water; and a spraying element airtightly screwed at an upper end thereof into a lower end of the nozzle body and having an inner diameter which is gradually decreased toward a spraying hole defined at a lower end thereof.

* * * * *